US005119781A

United States Patent [19]

Trombley et al.

[11] Patent Number: 5,119,781

[45] Date of Patent: Jun. 9, 1992

[54] CONTROL OF ENGINE FUEL INJECTION DURING TRANSITIONAL PERIODS ASSOCIATED WITH DECELERATION FUEL CUT-OFF

[75] Inventors: Douglas E. Trombley, Grosse Pointe; Kenneth J. Buslepp, Shelby; Paul E. Reinke, Rochester; Steven D. Stiles, Clarkston; Kenneth G. Macklem, Sterling Heights, all of Mich.

[73] Assignee: General Motors Corporation, Detroit, Mich.

[21] Appl. No.: 661,975

[22] Filed: Feb. 28, 1991

[51] Int. Cl.[5] ..... F02D 41/12

[52] U.S. Cl. ..... 123/325; 123/481

[58] Field of Search ..... 123/325, 326, 493, 481

[56] References Cited

U.S. PATENT DOCUMENTS

| | | | |
|---|---|---|---|
| 4,276,863 | 7/1981 | Sugasawa et al. | 123/325 |
| 4,535,744 | 8/1985 | Matsumura | 123/325 |
| 4,552,114 | 11/1985 | Sano et al. | 123/481 |

FOREIGN PATENT DOCUMENTS

| | | | |
|---|---|---|---|
| 60-222537 | 11/1985 | Japan | 123/481 |
| 63-55346 | 3/1988 | Japan | 123/481 |

*Primary Examiner*—Andrew M. Dolinar

*Attorney, Agent, or Firm*—Jimmy L. Funke

[57] ABSTRACT

A method is described for controlling the injection of fuel in a direct injected, multi-cylinder internal combustion engine, to smooth transients in engine output torque associated with a deceleration fuel cut-off mode of engine operation. This is accomplished by detecting engine operating conditions that call for the initiation of a transition associated with the decelaration fuel cut-off engine operating mode. In response to the detected operating conditions, a transitional period is initiated, during which the injection of fuel into a varying portion of engine cylinders is then interrupted. When the transitional period is associated with entry into the deceleration fuel cut-off mode, the injection of fuel to a progressively increasing number of cylinders is interrupted. When the transitional period is associated with recovery from the deceleration fuel cut-off mode, the injection of fuel to a progressively decreasing number of engine cylinders is interrupted. The rate of entry into the fuel cut-off mode is preferably fixed, while the rate of receovery is determined in accordance with the position of an engine control element for adjusting the amount of torque developed at the engine output. Alternatively, the rate of recovery may be determined by the maximum rate of positional change of the engine control element.

2 Claims, 5 Drawing Sheets

CONTROL OF ENGINE FUEL INJECTION DURING TRANSITIONAL PERIODS ASSOCIATED WITH DECELERATION FUEL CUT-OFF

BACKGROUND OF THE INVENTION

This invention relates to the control of fuel injection in a direct injected, multi-cylinder internal combustion engine, and more particularly, to a method of interrupting the injection of fuel into a varying portion of engine cylinders, during a transition associated with a deceleration fuel cut-off mode of engine operation.

Conventionally, the supply of fuel to all cylinders of an internal combustion engine is completely interrupted during a mode of engine operation commonly known as deceleration fuel cut-off (DFCO). Entry into the DFCO mode is customarily initiated when the engine is decelerating, with the engine control element (typically the throttle valve or accelerator pedal) positioned for engine idling The purpose of this mode of operation is to reduce fuel consumption and maximize engine braking induced by the drag, or negative torque applied by the engine load Recovery from the DFCO mode is generally initiated, when either the engine rotational speed drops below a predetermined minimum speed near idle, or the engine control element is moved from the idling position to accelerate engine rotation and increase output torque.

If an engine is quickly transferred from normal operation, to the deceleration fuel cut-off mode, or vice versa, the sudden transition in engine output torque from positive to negative, or negative to positive, results in undesirable ringing or jerking in the engine driveline. These torque transients are particularly noticeable, when a manual transmission is used in coupling the driveline to the engine.

According to conventional practice, the output torque transients are smoothed by gradually adjusting engine spark timing or the quantity of fuel injected into an engine, during entry into and recovery from the DFCO operating mode. Both of these traditional approaches have a negative impact on engine exhaust emissions, because they substantially increase the amount of hydrocarbons present in the engine exhaust.

Consequently, there exists a need for a method of controlling an internal combustion engine during entry and recovery from deceleration fuel cut-off, to provide smooth transitions between negative and positive engine output torque, without substantially increasing engine exhaust emissions.

SUMMARY OF THE INVENTION

The present invention provides a method for controlling the injection of fuel in a direct injected, multi-cylinder engine, to smooth transients in engine output torque associated with the deceleration fuel cut-off mode of engine operation. This is accomplished by detecting engine operating conditions which call for the initiation of a transition associated with the deceleration fuel cut-off mode. In response to the detected engine operating conditions, a transitional period is then initiated, during which the injection of fuel to a varying portion of the engine cylinders is interrupted. Thus, the positive output torque generated by the ignition of fuel in engine cylinders can be gradually changed during DFCO transitional periods, to smooth the transition between positive and negative torque at the engine output. Because the quantity of fuel ignited in a cylinder, and the timing of ignition is unaffected, the present method does not increase the hydrocarbon content in the engine exhaust.

When detected engine operating conditions indicate the initiation of a transitional period associated with entry into the DFCO mode, the injection of fuel to a progressively increasing portion of engine cylinders is interrupted to gradually reduce the positive torque generated by the engine. A fixed rate of entry into the fuel cut-off mode can be used to enhance driver perceived drivetrain smoothness. Thus, the injection of fuel to an engine cylinder is interrupted for a predetermined time, before the injection of fuel to an additional cylinder is interrupted. This sequence proceeds during the transitional period, until all engine cylinders are fully disabled to effectuate deceleration fuel cut-off.

When detected engine operating conditions indicate the initiation of a transitional period associated with recovery from the DFCO mode, the injection of fuel to a progressively decreasing portion of the engine cylinders is interrupted to increase the positive torque generated by the engine. A fixed rate for recovering from fuel cut-off is usually not preferable, since recovery may be initiated by a driver demanding rapid engine acceleration.

According to one embodiment of the invention, the rate of recovering from DFCO is determined in accordance with the position of the engine output control element (typically the accelerator pedal or throttle valve). One fixed rate of recovery is used, when the engine control element is positioned for engine idling. A second relatively faster fixed rate (shorter time between enabling the injection of fuel to successive cylinders) is used, when the engine control element is positioned off-idle, indicating driver demand for increased engine output. Consequently, perceived drivetrain smoothness is improved, by providing a more rapid recovery from fuel cut-off, when there is a demand for increased engine output.

According to another embodiment, a variable rate of recovery from DFCO is employed, based upon the maximum rate of change in the position of the engine control element. As a result, drivability is further improved by increasing the rate of recovery from DFCO, in response to an increase in the rate at which the driver demands and expects additional engine output.

These and other aspects and advantages of the invention may be best understood by reference to the following detailed description of the preferred embodiments, when considered in conjunction with the accompanying drawings.

DESCRIPTION OF THE PREFERRED EMBODIMENTS

Figure 1:
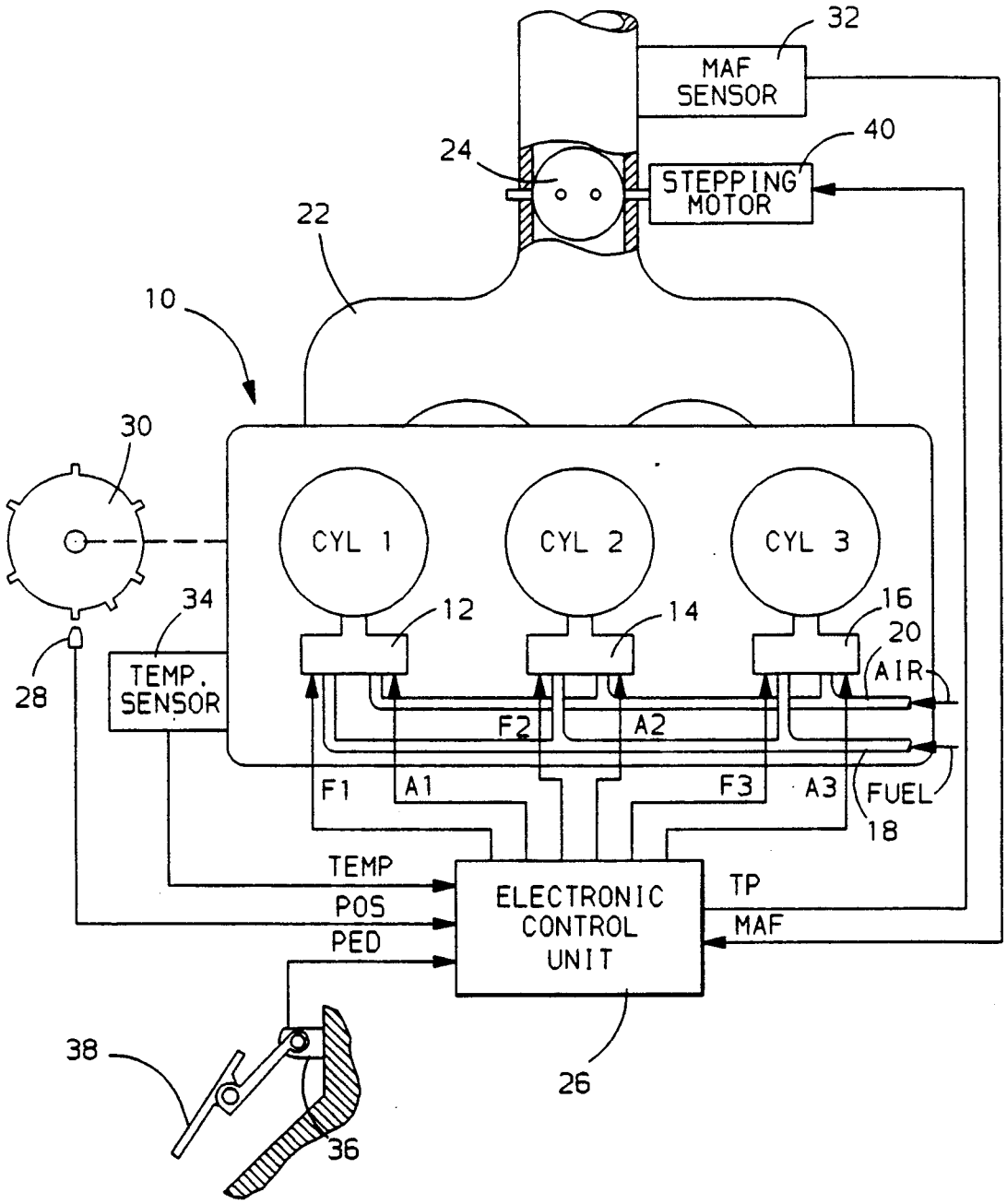
FIG. 1 schematically illustrates an internal combustion engine having direct cylinder fuel injection, which operates in accordance with the principles of the present invention.

Referring to FIG. 1, there is shown schematically a multi-cylinder internal combustion engine, generally designated as 10, having cylinders CYL1, CYL2, and CYL3. Each engine cylinder is individually fueled by a conventional pneumatic direct fuel injection system, which includes selectively operable, solenoid actuated fuel injectors 12, 14, and 16, and the associated conduit forming fuel rail 18 and air rail 20, which deliver fuel and compressed air, for injecting metered quantities of fuel into the cylinders. Engine 10 further includes an air intake manifold 22, with a throttle valve 24 therein, for controlling the quantity of air supplied to the engine.

As illustrated in FIG. 1, the operation of engine 10 is controlled by a conventional electronic control unit (ECU) 26, which derives input signals from several standard engine sensors. The ECU 26 includes a central processing unit, random access memory, read only memory, analog-to-digital and digital-to-analog converters, input/output circuitry, and clock circuitry, as will be recognized by those skilled in the art of computer engine control. The ECU 26 is supplied with a POS input signal that indicates the rotational position of engine 10. The POS input can be derived from a standard electromagnetic sensor 28, which is capable of detecting the passage of teeth on wheel 30, when it is rotated by engine 10. A MAF input signal indicates the mass air flow into engine 10, and can be obtained by any known means, as for example, a mass air flow (MAF) sensor 32 disposed in the engine intake manifold 22. In addition, a temperature sensor 34 provides the ECU 26 with an input signal TEMP, related to the engine coolant temperature; and a potentiometer 36 is employed to provide an input signal PED, which indicates the position of accelerator pedal 38.

During normal operation, the ECU 26 looks up the quantity of fuel to be injected into each cylinder from a table stored in memory, based upon the position of the accelerator pedal 38 (as indicated by the PED input signal). At appropriate rotational positions of the engine 10, as determined from the POS input signal, the ECU 26 generates pulsed signals F1–F3 and A1–A3, for respectively actuating the fuel and air solenoids (not shown), within injectors 12, 14, and 16. The width of the fuel pulses F1–F3, determines the metered quantity of fuel per cylinder (FPC) injected into the respective engine cylinders. The air pulses A1–A3 are timed in relation to the fuel pulses F1–F3, to supply the injectors with the appropriate volume of compressed air to drive the metered fuel into the engine cylinders.

To achieve the correct cylinder air-fuel ratio, ECU 26 computes a desired mass air flow in a conventional fashion from a lookup table based on current engine speed and amount of fuel injected per cylinder. The actual mass air flow to the engine, as indicated by the MAF signal, is then controlled to the desired value, in a closed loop fashion, by appropriately opening or closing throttle valve 24. The ECU 26 accomplishes this by generating a throttle position TP output signal to drive a stepping motor 40, that is mechanically coupled to throttle valve 24. Many of the additional sensor, actuators, and ECU input and output signals, that are generally present in a conventional engine control system, have not been specifically shown in FIG. 1, since they are not required in describing the present invention.

It is customary to completely interrupt the injection of fuel to all cylinders of an internal combustion engine, such as engine 10 of FIG. 1, during a mode of operation commonly referred to as deceleration fuel cut-off (DFCO). Entry into the DFCO mode is typically initiated when engine 10 is decelerating, with an engine control element, such as accelerator pedal 38, positioned for engine idling. The purpose of this mode of operation is to reduce fuel consumption and maximize engine braking induced by the drag, or negative torque applied by the engine load. Recovery from the DFCO mode is generally initiated when either the engine rotational speed drops below a predetermined minimum speed near idle, or the engine control element is moved from the idling position to accelerate the rotation of engine 10 and increase output torque.

If engine 10 is quickly transferred from normal operation, to the DFCO, or vice versa, the sudden transition in engine output torque from positive to negative, or negative to positive, results in undesirable ringing or jerking in the engine driveline (not shown). These torque transients are particularly noticeable, when a manual transmission is used in coupling the driveline to the engine According to conventional practice, the output torque transients are smoothed by gradually adjusting engine spark timing or the quantity of fuel injected into an engine, during entry into and recovery from the DFCO operating mode. Both of these traditional approaches have a negative impact on engine exhaust emissions, because they substantially increase the amount of hydrocarbons present in the engine exhaust.

Consequently, there exists a need for a method of controlling an internal combustion engine during entry and recovery from DFCO, to provide smooth transitions between negative and positive engine output torque, without substantially increasing engine exhaust emissions.

The present invention is directed toward providing a method for smoothing transients in engine output torque associated with DFCO operation, without increasing the hydrocarbon content in the engine exhaust. This is accomplished by detecting engine operating conditions that call for the initiation of a transition associated with the deceleration fuel cut-off mode. In response to these detected operating conditions, a transitional period is initiated, during which the injection of fuel into a varying portion of the cylinders of engine 10 is interrupted. Thus, the positive output torque generated by the ignition of fuel in engine cylinders can be changed gradually during DFCO transitional periods, to smooth transition between positive and negative torque at the engine output. Because the quantity of fuel ignited in a cylinder, and the timing of ignition is unaffected by the present method, the hydrocarbon content in the engine exhaust gas is not increased.

Figure 2:
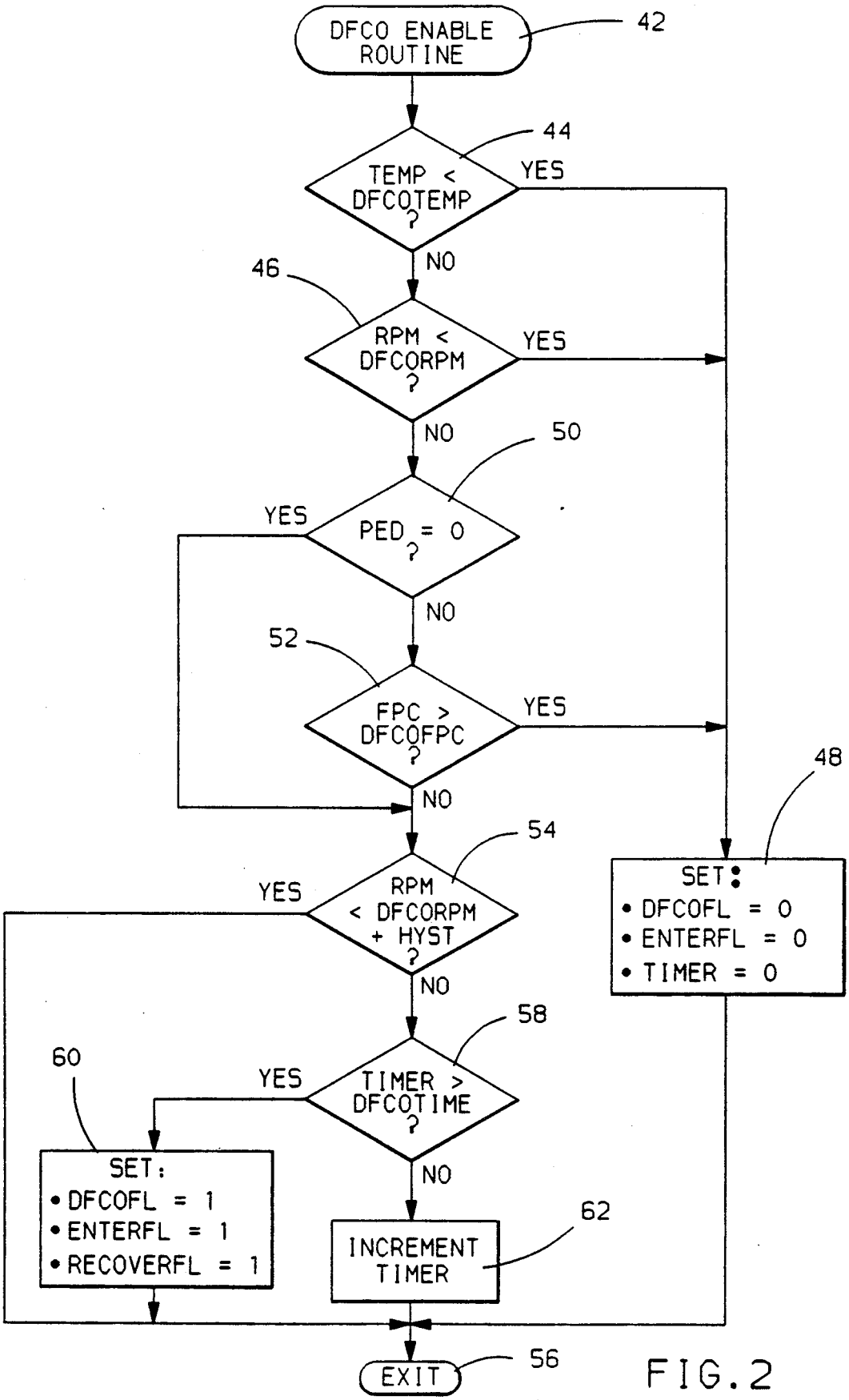
FIG. 2 is a flow diagram representative of the steps executed by the electronic control unit shown in FIG. 1, when detecting engine operating conditions, that call for the initiation of a transition associated with the deceleration fuel cut-off mode of engine operation.

Referring now to FIG. 2, there is shown a flow diagram representative of the steps executed by ECU 26 in detecting engine operating conditions calling for the initiation of a transition associated with the DFCO mode of engine operation. After engine startup, all counter, flags, registers, and timers within the ECU 26 are initialized to the appropriate values. After this initialization, the DFCO enable routine of FIG. 2 is continuously executed as part of the main looped engine control program stored within ECU 26.

The routine is entered at point 42 and proceeds directly to step 44. At step 44, a decision is required as to whether the engine coolant temperature, as indicated by the TEMP input signal, is less than a predetermined temperature DFCOTEMP (for example, 70° C.), below which entry into DFCO is prohibited because the engine has not adequately warmed up. If TEMP is not less than DFCOTEMP, the routine proceeds to step 46; otherwise, it proceed to step 48.

When the routine proceeds to step 46, another decision is required as to whether RPM, the rotational speed of the engine, is less than a predetermined speed DFCORPM. A value for RPM can be derived from the POS input signal to ECU 26, by counting the number of equally spaced tooth pulses occurring in a specified time period. When the engine speed is less than DFCORPM (for example, 1500 revolutions per minute), the engine is so close to idle that substantially no benefit would be realized by enabling DFCO. Thus, if RPM is less than DFCORPM, the routine proceeds to step 48. However if RPM is not less than DFCORPM, the routine then proceeds to step 50.

At step 50 a decision is required as to whether the engine is operating at idle. For the embodiment illustrated in FIG. 1, this is accomplished by determining whether the PED input signal is equal to zero (i.e. the accelerator pedal is in the idle position). In other embodiments where the accelerator pedal is directly linked to the intake throttle valve, this could also be accomplished by determining whether the throttle valve was positioned for idling. If PED equals zero, entry into DFCO is not prohibited and the routine proceeds to step 54. If PED does not equal zero, indicating operator demand for engine output above idle, the the routine proceeds to step 52.

At step 52, the quantity of fuel injected per cylinder FPC is checked to determine if it exceeds a predetermined amount DFCOFPC (for example, 2 milligrams per cylinder per cycle). If FPC is not greater than the relatively small amount represented by DFCOFPC, the engine is considered to essentially be at idle, even though the accelerator pedal is not positioned exactly for idling, and the routine proceeds to step 54. However, if FPC is greater that DFCOFPC, the engine is considered not to be at, or near idle, and the routine proceeds to step 48.

When the routine proceeds to step 54, a decision is required as to whether the engine rotational speed RPM is less than the predetermined engine speed DFCORPM used at step 46, plus a hysteresis factor HYST (for example, 200 revolution per minute). If RPM is less than DFCORPM+HYST (in this case, 1700 revolutions per minute), the routine proceeds to step 56, where the routine is exited. However, if RPM is not less than DFCORPM +HYST, the routine proceeds to step 58.

At step 58, a decision is required as to whether a value of the TIMER exceeds a predetermined time DFCOTIME (for example, 500 milliseconds). If TIMER is greater that DFCOTIME, the routine proceeds to step 60, where flags DFCOFL, ENTERFL, and RECOVERFL are all set to a value of one, to indicate that engine operating conditions exist for initiating entry into DFCO, after which the routine is exited at point 56. However, if the value of TIMR does not exceed DFCOTIME, at step 58, the routine proceeds to step 62, where the value of the TIMER is incremented, prior to exiting the routine at point 56.

If the routine proceeds to step 48 from either of steps 44, 46, or 52, the DFCOFL flag, the ENTERFL flag, and the TIMER are all set to values of zero, indicating that engine operating conditions do not exist for initiating entry into DFCO. After setting these values, the routine is exited at point 56.

In summary, when the engine operating conditions are such that (1) the coolant temperature is less than DFCOTEMP; (2) the engine rotation speed is not less than DFCORPM+HYST; (3) either the accelerator pedal is at the idle position, or the quantity of fuel injected per cylinder per cycle is not greater DFCOFPC; and (4) the these conditions have not changed for a period of time defined by DFCOTIME, the routine will proceed to step 60, where flags are set to initiate entry into the DFCO mode.

When the engine operating conditions are such that either (1) the coolant temperature is not less than DFCOTEMP; (2) the engine rotational speed is not less than DFCORPM; or (3) the accelerator pedal is not at idle and the fuel injected per cylinder per cycle is is greater than DFCOFPC, the routine proceeds to step 48, where flags are set to initiate recovery from DFCO, when the engine is operating in that mode.

When operating conditions exist for initiating entry into DFCO, except that engine rotational speed falls within the range between DFCORPM and DFCORPM+HYST (step 44 in combination with step 54), the routine is exited without setting the entry flags at step 60, or incrementing the TIMER at step 62. This prevent oscillations between setting the entry flags at step 60 and the recovery flags at step 48, that would otherwise occur, if the engine rotational speed were to swing slightly above and below the defined DFCORPM speed.

According to another aspect of the present invention, when detected engine operating conditions call for the initiation of a transition associated with entry into the DFCO mode, the injection of fuel to a progressively increasing portion of engine cylinders is interrupted, thereby gradually reducing the positive torque generated by the engine. In its simplest form, a fixed rate of entry into DFCO may be used to enhance driver perceived drivetrain smoothness. Thus, the injection of fuel to an engine cylinder is interrupted for a predetermined time, before the injection of fuel to an additional cylinder is interrupted. This sequence proceeds during the DFCO entry transitional period, until all engine cylinders are fully disabled to effectuate the DFCO mode.

Figure 3:
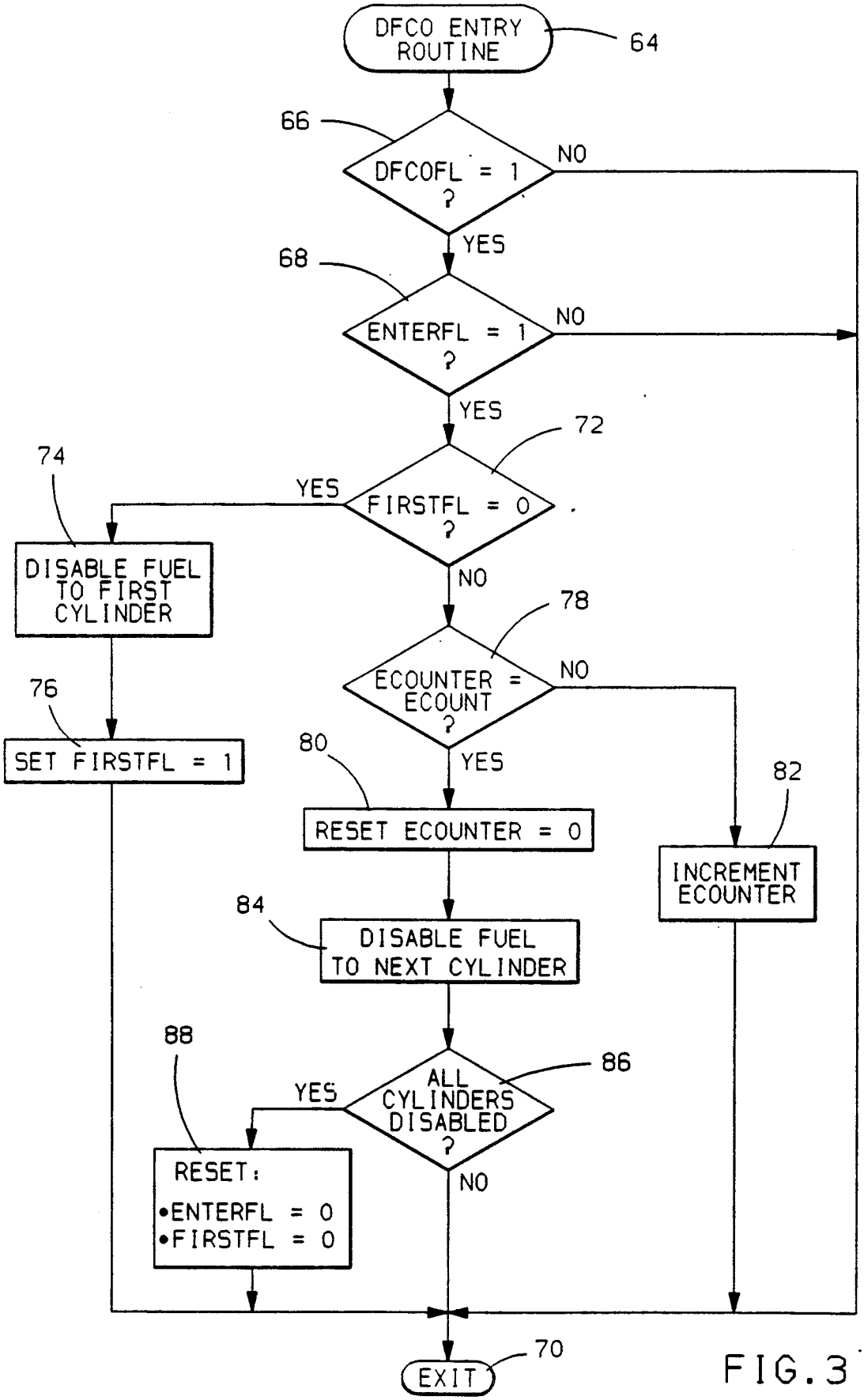
FIG. 3 is a flow diagram representative of the steps executed by the electronic control unit of FIG. 1, when entering into the fuel cut-off mode, by interrupting the injection of fuel to a progressively increasing portion of the engine cylinders.

Referring now to FIG. 3 there is shown flow diagram representative of the steps executed by ECU 26, when entering DFCO, by interrupting the injection of fuel to a progressively increasing portion of the cylinders of engine 10, in response to the operating conditions detected in the routine of FIG. 2.

The DFCO entry routine is entered at point 64, and forms a portion of the main looped engine control program that is continuously executed by ECU 26.

At step 66, a decision is required as to whether the DFCOFL flag is equal to one. If DFCOFL has been set to a value of one, this indicates the detection of engine operating conditions that call for the initiation of entry into the DFCO operating mode. If DFCOFL equals one, the routine proceeds to step 68; otherwise, the routine is exited at point 70.

At step 68, the ENTERFL flag is checked to determine whether it has a value of one. If the ENTERFL has a value of one, this indicates that the transitional period associated with entering DFCO has not been completed. When ENTERFL equals one, the routine proceeds to step 72; otherwise, the routine is exited at point 70.

Next at step 72, a decision is required as to whether a FIRSTFL flag has a value of zero. When FIRSTFL equals zero, this indicates that the injection of fuel to a first designated engine cylinder, for example CYL1, has not yet been interrupted. If FIRSTFL equals zero, the routine proceeds to step 74, otherwise it proceeds to step 78.

When the routine passes to step 74, the injection of fuel to the first engine cylinder (CYL1) is interrupted. This may be accomplished by either masking or gating the fuel and air output signal pulses, so they do not arrive at fuel injector 12. Alternatively, the widths of these pulses could be set to a value of zero, which will effectively eliminate the pulses. In the preferred embodiment of the present invention, it has been found advantageous to interrupt the air pluses as well as the fuel pulses to pneumatic type injectors. This prevents the air pulses from drying out the residual fuel remaining in the injectors, after the fuel pulses are interrupted, and assures that the proper quantity of fuel will immediately be injected into the cylinders, when the fuel pulses are again applied to the injectors. Once the fuel to the first cylinder has been interrupted, the routine passes first to step 76, where the FIRSTFL flag is set to a value of one. The routine is then exited at point 70.

If the injection of fuel to the first engine cylinder has been interrupted as described above, the routine will pass to step 78, from decision step 72. At step 78, an additional decision is required as to whether a counter ECOUNTER has achieved the value of ECOUNT (corresponding for example, to 100 milliseconds). If ECOUNTER is equal to ECOUNT the routine proceeds to step 80, otherwise it passes to step 82, to increment the ECOUNTER, prior to exiting the routine at point 70.

When the routine passes to step 80, the ECOUNTER is reset to a value of zero, and the routine then proceeds to step 84, where the injection of fuel to the next engine cylinder is interrupted. For the engine shown in FIG. 1, the injection of fuel to cylinder CYL2 could be interrupted on the first pass through this portion of the routine, with the injection of fuel to cylinder CYL3 being interrupted on the next pass.

From step 84, the routine proceeds to step 86, where a decision is required as to whether the injection of fuel to all engine cylinders has been interrupted. If all cylinders have been disabled, the engine is operating in the DFCO mode, and the routine passes to step 88 to reset the ENTERFL and FIRSTFL flags to zero, before exiting the routine at point 70. If all engine cylinders have not been disabled at step 86, the routine is immediately exited at point 70.

In summary, when engine operating conditions are detected for initiating a transitional period for entry into DFCO, the injection of fuel to a first engine cylinder is interrupted (step 74). When a predetermined period of time corresponding to the count of ECOUNT elapses (step 78), the injection of fuel to another engine cylinder is interrupted. This sequence continues until the injection of fuel to all cylinders has been interrupted and the engine is operating in the DFCO mode. The fixed value for ECOUNT may be changed, to increase or decrease the rate of entry into DFCO, and enhance driver perceived drivetrain smoothness.

According to another aspect of the present invention, when detected engine operating conditions call for the initiation of a transitional period associated with recovery from the DFCO mode, the injection of fuel to a progressively decreasing portion of the engine cylinders is interrupted, thereby gradually increasing the positive torque generated by the engine. A fixed rate for recovering from fuel cut-off is generally not preferable, since recovery may be initiated by a driver demanding rapid engine acceleration.

In one embodiment of the invention, the rate of recovering from DFCO is determined in accordance with the position of the engine output control element (in this case the accelerator pedal). One fixed rate of recovery is used, when the engine control element remains positioned for engine idling. A second relatively faster fixed rate (shorter time between enabling the injection of fuel to successive cylinders) is used, when the engine control element is positioned off-idle, indicating driver demand for increased engine output. Consequently, perceived drivetrain smoothness is improved, by providing a more rapid rate of recovery from DFCO, when there is a demand for increased engine output.

Figure 4:
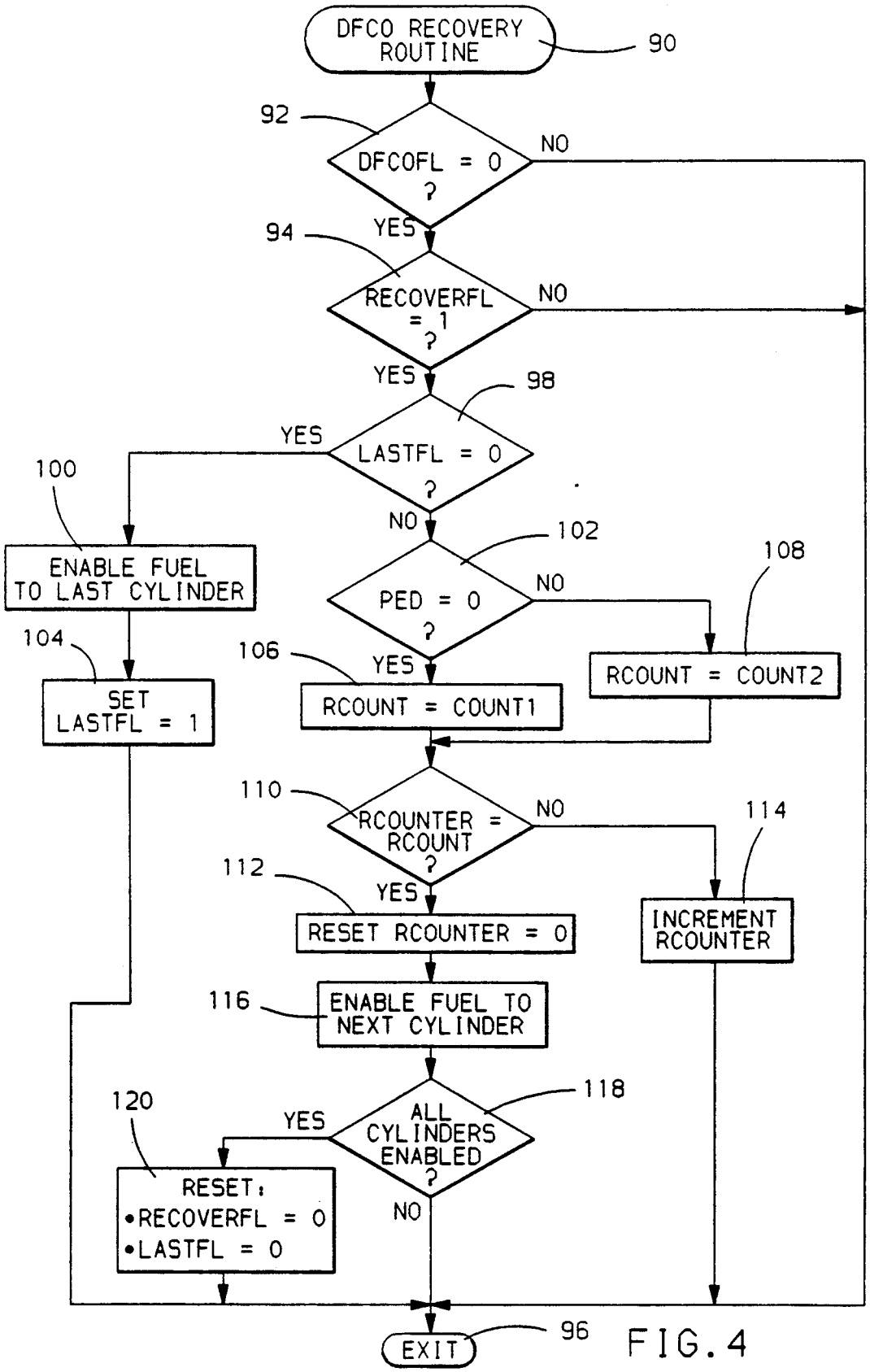
FIG. 4 is a flow diagram representative of the steps executed by the electronic control unit of FIG. 1, when recovering from the fuel cut-off mode, by interrupting the injection of fuel into a decreasing portion of the engine cylinders, at a rate determined by the position of the engine output control element.

Referring now to FIG. 4, there is shown a flow diagram representative of the steps executed by the ECU 26 of FIG. 1, when recovering from DFCO, by interrupting the injection of fuel into a progressively decreasing portion of the cylinders of engine 10, at a rate determined by the position of the engine accelerator pedal 38.

The DFCO recovery routine of FIG. 4 is entered at point 90 and is executed continuously as part of the main looped engine control program stored in ECU 26. From point 90, the routine proceeds directly to step 92.

At step 92, a decision is required as to whether the DFCOFL flag is equal to zero. If DFCOFL has been set to a value of zero, this indicates that engine operating conditions have been detected for initiating recovery from the DFCO mode of engine operation (see step 48 of FIG. 2). If DFCOFL equals zero the routine proceeds to step 94, otherwise, the routine is exited at point 96.

At step 94, the RECOVERFL flag is checked to determine if it has a value of one. When the RECOVERFL has a value of one, this indicates that the transitional period for recovering from DFCO has not been completed When RECOVERFL equals one, the routine proceeds to step 98, otherwise, the routine is exited at point 96.

At step 98, a decision is required as to whether a LASTFL flag has a value of zero. When LASTFL equals zero, this indicates that the injection of fuel to a designated last engine cylinder (cylinder CYL3 for the embodiment illustrated in FIG. 2), is still being interrupted. If LASTFL equals zero, the routine proceeds to step 100, otherwise it proceeds to step 102.

When the routine passes to step 100, interruption of fuel injection to the last engine cylinder (CYL3) is ended, by permitting the normal fuel and air pulses of F3 and A3 to actuate fuel injector 16. Once the last cylinder has been enabled, the routine passes to step 104, where the LASTFL flag is set to a value of one, and then exits at point 96.

If the interruption of fuel injection to the last cylinder has ended as described above, the routine will pass to step 102 from step 98. At step 102, a decision is required as to whether the accelerator pedal 38 is positioned for engine idling. This is accomplished by checking the value of PED to determine if it equals zero. If PED equals zero, the routine proceeds to step 106, where RCOUNT is given the value of COUNT1. However, if PED is not equal to zero, indicating a demand for engine output above idle, the routine proceeds to step 108, where RCOUNT is set to a value of COUNT2 In either case, the routine then passes to step 110.

At step 110, a decision is required as to whether a counter RCOUNTER has achieved the value of RCOUNT (where RCOUNT corresponds for example, to 100 milliseconds if set equal to COUNT1 at step 106, or to 30 milliseconds if set to COUNT2 at step 108). If RCOUNTER is equal to RCOUNT, the routine proceeds to step 112; otherwise, it passes to step 114, to increment the RCOUNTER and then exits at point 96.

When the routine passes to step 112, the RCOUNTER is reset to a value of zero, and the routine then proceeds to step 116, where the interruption of fuel injection to the next engine cylinder is ended. For the engine shown in FIG. 1, CYL2 could be enabled on the first pass through this portion of the routine, with cylinder CYL1 being enabled on the next pass.

From step 116, the routine proceeds to step 118, where a decision is required as to whether the interruption of fuel to all engine cylinders has ended. If all cylinders have been enabled, the engine has fully recovered from DFCO and is operating normally In this case, the routine passes to step 120, where the flags RECOVERFL and LASTFL are reset to zero, before exiting at point 96. If all engine cylinders have not been enabled at step 118, the routine immediately exist at point 96.

In summary, when engine operating conditions are detected for initiating a transitional period for recovering from DFCO, the interruption of fuel injection to the last engine cylinder is ended (step 104). After a period of time corresponding to the count of RCOUNT has elapsed (step 110), the interruption of fuel injection to another engine cylinder is ended. This sequence continues until all engine cylinders have been enabled and the engine is operating normally. Note that one rate of recovering from DFCO is established by setting RCOUNT to the value of COUNT1 (step 106), when the accelerator pedal remains positioned for engine idling. Another rate of DFCO recovery is established by setting RCOUNT equal to the value of COUNT2 (step 108), when the accelerator pedal is moved from the idle position. Thus, the rate of recovering from DFCO is determined in accordance with the position of accelerator pedal 38. By giving RCOUNT2 a relatively smaller value than RCOUNT1, the rate of recovery from DFCO can be increased, when a driver demands increased engine output.

In another embodiment of the present invention, a variable rate of recovery from fuel cut-off is provided for, based upon the maximum rate of change in the position of the engine control element. This further improves drivability by increased rate of recovery from DFCO, in response to an increase in the rate at which the driver demands and expects additional engine output.

Figure 5:
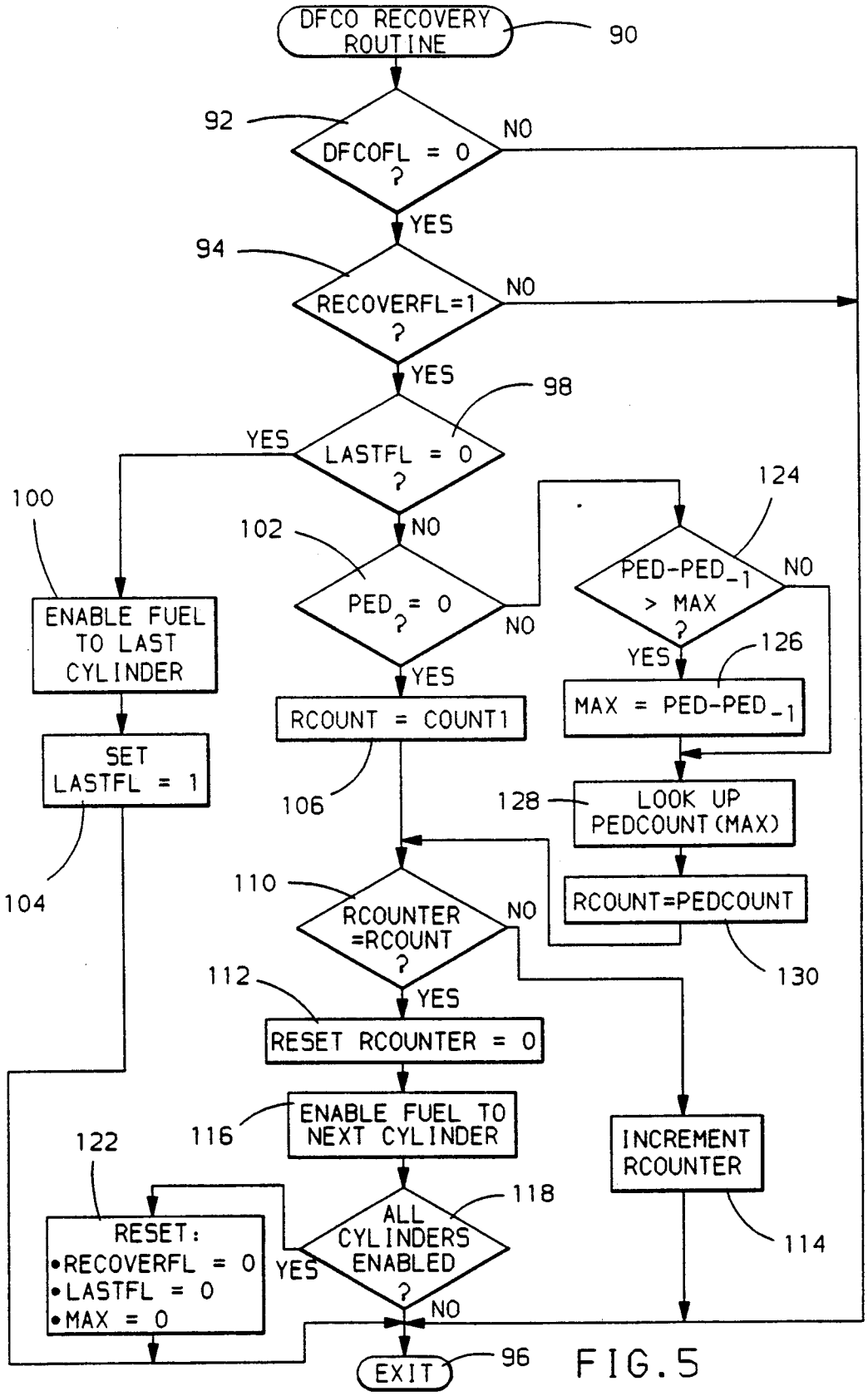
FIG. 5 is a flow diagram representative of the steps executed by the electronic control unit of FIG. 1, when recovering from deceleration fuel cut-off, by interrupting the injection of fuel to a progressively decreasing portion of engine cylinders, at a rate determined by the maximum rate of positional change in the engine output control element.

Referring now to FIG. 5, there is shown a flow diagram representative of the steps executed by the ECU of FIG. 1, when recovering from DFCO at a variable rate determined by the maximum rate of positional change of the accelerator pedal 38. The flow diagram of FIG. 5 contains many identically numbered steps that were previously discussed in relation to FIG. 4. Consequently, the present discussion will be limited to those changes introduced by the substitution of different steps into the routine of FIG. 5, for steps 108 and 120 in the routine of FIG. 4.

In replacing step 108 of FIG. 4, with the new steps 124–130 of FIG. 5, the rate of recovering from DFCO is made to depend upon the maximum rate of positional change of the accelerator pedal 38. After determining that the accelerator pedal is not position for idling at step 102, the routine proceeds to step 124.

At step 124, a decision is required as to whether the quantity $(PED-PED_{-1})$ is less than a the value of a variable MAX (initialized to zero on engine start up). As discussed previously, PED indicates the present position of the accelerator pedal 38, and $PED_{-1}$ represents the value for PED, stored in memory during the previous pass through the routine. Thus, the quantity $(PED-PED_{-1})$ provides a measure of the present rate of change in the position of the accelerator pedal 38. If the presently determined rate of change in the accelerator pedal position is not greater than MAX, the routine proceeds to step 128; otherwise, the routine passes to step 126, where the MAX is assigned the larger value for $(PED-PED_{-1})$, prior to passing to step 126.

At step 126, a value for PEDCOUNT is looked up in a stored table as a function of the value of MAX. The table values for PEDCOUNT should decrease with increasing values for MAX, with the exact functionality being determined by testing to obtain a desired drivability. Next, the routine proceeds to step 130, where RCOUNT is assigned the value of PEDCOUNT looked up at step 128. The routine then passes to step 110 and continues as previously described in the routine of FIG. 4.

Additionally, step 120 of FIG. 4 was changed to step 122 in FIG. 5 to assure that the value of MAX is reset to zero, after completion of the DFCO recovery transitional period.

In summary, the changes introduced by the replacement steps in FIG. 5, provide for a variable DFCO recovery rate, when the accelerator pedal is moved from the idle position. The rate of recovery, as determined by RCOUNT (at step 110), is increased (shorter time between enabling cylinders), as the maximum rate of change in pedal position increases. This improves drivability by providing a variable rate of recovery from DFCO, based upon the rate at which a driver demands increased engine output.

In the above embodiments of the present invention, the position of accelerator pedal 38 was used as the engine output control element to detect driver demand for engine output. It will be recognized by those skilled in the art that other devices may be used for this purpose, such as the position of throttle control valve 24, in applications where accelerator pedal 38 is mechanically linked to move the throttle valve 24.

It will also be recognized that for engines having more than three cylinders, the present invention can be easily adapted to disable or enable sets of cylinders simultaneously when entering into or recovering from DFCO. For example, it may be desirable to disable or enable the injection of fuel for two cylinders at a time, when entering into or exiting from DFCO in six or eight cylinder engines.

Thus, the aforementioned description of the preferred embodiments of the invention is for the purpose of illustrating the invention, and is not to be considered as limiting or restricting the invention, since many modifications may be made by the exercise of skill in the art without departing from the scope of the invention.

The embodiments of the invention in which an exclusive property or privilege is claimed are defined as follows:

1. In a multi-cylinder internal combustion engine having a fuel delivery system for directly injecting fuel into each engine cylinder and a positionable engine output control element for adjusting the amount of output torque generated by the engine, a method for smoothing transients in engine output torque associated with a deceleration fuel cut-off mode of engine operation. the steps of the method comprising:

detecting engine operating conditions that call for the initiation of a transition associated with recovery from the deceleration fuel cut-off mode of engine operation; and initiating a transitional period in response to the detected engine operating conditions. during which the injection of fuel to a progressively decreasing portion of the engine cylinders is interrupted at a rate determined in accordance with the position of the engine output control element.

2. In a multi-cylinder internal combustion engine having a fuel delivery system for directly injecting fuel into each engine cylinder and a positionable engine output control element for adjusting the amount of output torque generated by the engine, a method for smoothing transients in engine output torque associated with a deceleration fuel cut-off mode of engine operation, the steps of the method comprising:

detecting engine operating conditions that call for the initiation of a transition associated with recovery from the deceleration fuel cut-off mode of engine operation; and initiating a transitional period in response to the detected engine operating conditions, during which the injection of fuel to a progressively decreasing portion of the engine cylinders is interrupted at a rate determined in accordance with the maximum rate of change in the position of the engine output control element.

* * * * *